US005474888A

United States Patent [19]

Bell

[11] Patent Number: 5,474,888

[45] Date of Patent: Dec. 12, 1995

[54] PHOTOGRAPHIC EMULSION CONTAINING TRANSITION METAL COMPLEXES

[75] Inventor: Eric L. Bell, Webster, N.Y.

[73] Assignee: Eastman Kodak Company, Rochester, N.Y.

[21] Appl. No.: 331,789

[22] Filed: Oct. 31, 1994

[51] Int. Cl.[6] ..... G03C 1/09

[52] U.S. Cl. ..... 430/567; 430/604; 430/605

[58] Field of Search ..... 430/567, 604, 430/605

[56] References Cited

U.S. PATENT DOCUMENTS

| | | | |
|---|---|---|---|
| 3,672,901 | 6/1972 | Ohkubo et al. | 96/94 |
| 3,901,713 | 8/1975 | Yamasue et al. | 96/95 |
| 4,147,542 | 4/1979 | Habu et al. | 96/27 E |
| 4,828,962 | 5/1989 | Grzeskowiak et al. | 430/230 |
| 4,835,093 | 5/1989 | Janusonis et al. | 430/567 |
| 4,933,272 | 6/1990 | McDugle et al. | 430/567 |
| 4,937,180 | 6/1990 | Marchetti et al. | 430/567 |
| 4,945,035 | 7/1990 | Keevert, Jr. et al. | 430/567 |
| 5,252,451 | 10/1993 | Bell | 430/567 |
| 5,256,530 | 10/1993 | Bell | 430/567 |
| 5,360,712 | 11/1994 | Olm et al. | 430/567 |

FOREIGN PATENT DOCUMENTS

| | | | |
|---|---|---|---|
| 0325235 | 7/1989 | European Pat. Off. | G03C 1/08 |
| 0457298 | 11/1991 | European Pat. Off. | G03C 1/08 |
| 92/16876 | 1/1992 | WIPO | G03C 1/08 |

*Primary Examiner*—Janet C. Baxter
*Attorney, Agent, or Firm*—Peter C. Cody

[57] ABSTRACT

The present invention provides a photographic emulsion silver halide grains having incorporated therein or thereon a dopant, a grain surface modifier, and a hexacoordination complex comprising iridium, wherein the grain surface modifier is a transition metal complex comprising a nitrosyl or thionitrosyl ligand with a transition metal selected from the Groups 5 to 10, inclusive, of the periodic table, and the dopant is a transition metal complex comprising a transition metal, other than iridium, which is selected from Groups 7 to 10 of the periodic table.

25 Claims, No Drawings

PHOTOGRAPHIC EMULSION CONTAINING TRANSITION METAL COMPLEXES

FIELD OF THE INVENTION

This invention relates to photographic emulsions. In particular, it relates to photographic silver halide emulsions containing a combination of transition metal complexes.

BACKGROUND OF THE INVENTION

In both color and black and white photography, there exists the desire for products which exhibit increased contrast upon exposure to light and subsequent development. This desire is based upon the realization that contrast is directly related to the appearance of sharpness. Products which exhibit increased contrast give the visual impression of enhanced sharpness. Conversely, products which exhibit decreased contrast give the visual impression of diminished sharpness.

Traditionally, photographers have defined contrast by two methods, both of which are derived from the D-log E curve (also known as the "characteristic curve"; see James, *The Theory of Photographic Properties,* 4th ed. pp 501–504). The first method is the determination of gamma ($\gamma$) which is defined as the slope of the straight-line section of the D-log E curve. The second is the determination of the overall sharpness of the toe section of the D-log E curve. By sharpness of the toe section, it is usually meant the relative density of the toe section. For instance, a sharp toe corresponds to a relatively low (small) toe density, and a soft toe corresponds to a relatively high (large) toe density. Generally, the point at which toe density is measured corresponds to 0.3 log E fast of the speed point, although toe density may properly be measured at any point prior to the curve's primary increase in slope. The speed point typically corresponds to the point on the D-log E curve where density equals 1.0.

If either the value of $\gamma$ is high or the toe is sharp, then the image has a relatively high contrast. If the value of $\gamma$ is low or the toe is soft, the image has a relatively low contrast.

It is known that in attempts to maximize the contrast of photographic elements based on silver halide emulsions (as well as other characteristics of the photographic element), silver halide emulsions have been doped with various transition metal ions and compounds. Dopants are substances added to the emulsion during silver halide precipitation which become incorporated within the internal structure of the silver halide grains. Because they are internally incorporated, they are distinguished from substances added post-precipitation such as chemical or spectral sensitizers. These latter compounds are externally associated with the surface of the silver halide grains and are thus more properly referred to as addenda or grain surface modifiers.

Depending on the level and location of dopants, they may modify the photographic properties of the grains. When the dopants are transition metals which form a part of a coordination complex, such as a hexacoordination complex or a tetracoordination complex, the ligands can also be occluded within the grains, and they too may modify the grain's photographic properties.

Specific examples of doped silver halide emulsions can be found in U.S. Pat. Nos. 4,147,542, which discloses the use of iron complexes having cyanide ligands; U.S. Patents 4,945,035 and 4,937,180 which disclose the use of hexacoordination complexes of rhenium, ruthenium and osmium with at least four cyanide ligands; and U.S. Pat. No. 4,828,962, which discloses the use of ruthenium and iridium ions to reduce high intensity reciprocity failure (HIRF).

Recently, emulsion dopants have been described which comprise transition metal complexes having nitrosyl or thionitrosyl ligands. European Patent Applications 0325235 and 0457298 disclose the use of one such complex, namely potassium ferric pentacyanonitrosyl. A second type of dopant, rhenium nitrosyl or rhenium thionitrosyl is disclosed in U.S. Pat. No. 4,835,093; and a third, dicesium pentachloronitrosyl osmate, is disclosed in U.S. Pat. No. 4,933,272.

It has also been known to use combinations of dopants in silver halide emulsions. Such combinations of dopants can be found in U.S. Pat. No. 3,901,713, which discloses the addition of both rhodium and iridium compounds during emulsification or the first ripening; and in U.S. Pat. No. 3,672,901, which teaches the combined use of iron compounds and iridium or rhodium salts.

Methods of improving the photographic characteristics of silver halide emulsions have also consisted of adding transition metals to the emulsions during chemical or spectral sensitization. As mentioned, transition metals added in this manner, because they are added subsequent to silver halide precipitation, are referred to as grain surface modifiers rather than dopants.

The most prevalent chemical sensitizers are the gold and sulfur sensitizers, both of which are thought to enhance emulsion speed by forming electron traps and/or photoholes on the silver halide crystal surface. Sensitization has also been accomplished by the addition of other transition metals. Specifically, platinum salts have been used, although sensitization with such salts is strongly retarded by gelatin. In addition, iridium salts and complex ions of rhodium, osmium, and ruthenium have been used as chemical sensitizers (and also as dopants). The overall effect of these metals on sensitivity appears to be dependent upon their valence state.

Combinations of grain surface modifiers and dopants, or of two grain surface modifiers, have been utilized and are disclosed in, for example, U.S. Pat. Nos. 5,252,451 and 5,256,530.

Although it is known to employ transition metals, and combinations thereof, as either dopants or grain surface modifiers, prior applications of such transition metals have yielded emulsions exhibiting inferior contrast improvement. This has often been the result of one dopant or grain surface modifier exerting an insufficient effect; or the result of a combination of dopants or grain surface modifiers exerting opposing effects.

Accordingly, it would be desirable to overcome these deficiencies by providing a high contrast silver halide emulsion exhibiting a high $\gamma$ and/or sharpened toe, wherein a combination of dopants and grain surface modifiers imparts the high contrast characteristic.

SUMMARY OF THE INVENTION

The present invention provides a photographic silver halide emulsion comprising silver halide grains having incorporated therein or thereon a dopant, a grain surface modifier, and a hexacoordination complex comprising iridium, wherein the grain surface modifier is a transition metal complex comprising a nitrosyl or thionitrosyl ligand with a transition metal selected from the Groups 5 to 10, inclusive, of the periodic table, and the dopant is a transition metal complex comprising a transition metal, other than iridium, which is selected from Groups 7 to 10, inclusive, of the periodic table.

The dopant utilized in accordance with the present invention is further characterized in that it is added to the emulsion during the precipitation of the silver halide crystals. Thus, it is incorporated into the internal structure of the crystalline grains. The grain surface modifier, by contrast, is added to the emulsion after silver halide precipitation. It is adsorbed to the surface of the crystal grain, rather than incorporated internally, and it, in combination with the dopant and the hexacoordination complex comprising iridium, improves the contrast of the silver halide emulsion beyond that thought previously possible.

The hexacoordination complex comprising iridium is incorporated into the internal structure of the crystalline grains as a dopant, or it is adsorbed to the surface of the grains as a grain surface modifier.

In one aspect of the invention, the dopant, grain surface modifier, and hexacoordination complex comprising iridium are applied to silver chloride grains that are substantially free of silver bromide or silver iodide. In another aspect of the invention, the grain surface modifier is positioned at intervals along the surface of the silver chloride grains in a silver halide carrier. The silver halide carrier, in such instances, accounts for less than about two, and preferably less than about one, mole percent of the total silver halide of each crystal.

In these instances, the emulsions containing the combination of the dopant, grain surface modifier and hexacoordination complex comprising iridium exhibit improved contrast.

DETAILED DESCRIPTION OF THE INVENTION

In the description of the present invention, reference is made to certain groups of the periodic table. The periodic table defining these groups is that adopted by the American Chemical Society and published in the *Chemical and Engineering News*, Feb. 4, 1985, p.26.

Components of silver halide emulsions are often distinguished by whether they are internally or externally associated with the silver halide crystal grains. Compounds which are added during silver halide precipitation, as mentioned previously, are internally incorporated within the crystal structure, and are thus termed dopants. By contrast, compounds added after precipitation become associated with the external surface of the grains. A variety of terms is used to define these compounds, including addenda and grain surface modifiers.

The present invention concerns high contrast silver halide emulsions containing a combination of a dopant, grain surface modifier, and hexacoordination complex comprising iridium. The dopant is preferably incorporated through at least 10 percent, more preferably through at least 50 percent, and even more preferably through at least 70 percent of the total volume of the silver halide grains. In certain instances, it is desirable that the dopant be incorporated throughout a 90–95 percent core region of each silver halide grain; i.e., it is added during precipitation until 90–95 percent of the grain volume is formed. It may also, however, be added to the emulsion at a later stage of precipitation, as long as it is positioned below the surface of the silver halide grain.

Banding of the dopant in a particular region of the grain is also possible. For instance, it is contemplated that the dopant be incorporated throughout a 25 to 75 percent region of each grain, or throughout a 75 to 95 percent region of each grain.

The dopant utilized in accordance with the invention is a transition metal complex comprising a transition metal, other than iridium, which is selected from Groups 7 to 10, inclusive, of the periodic table. As such, it includes a transition metal selected from iron, ruthenium, osmium, and rhenium. Preferably, the dopant comprises a transition metal selected from Group 8 of the periodic table.

Preferably, the dopant is a hexacoordination complex that comprises cyanide ligands. More preferably, it has the structure:

$$[M(CN)_{6-y}L_y]^n$$

wherein

M is defined as a Group 7 to 10 transition metal, other than iridium, and is preferably a Group 8 transition metal;

L is ligand;

y is 0, 1, 2, or 3; and n is 0, −1, −2, −3, or −4.

Specific examples of ligands include aquo ligands, halide ligands, cyanide ligands, cyanate ligands, thiocyanate ligands, selenocyanate ligands, tellurocyanate ligands, azide ligands, and organic ligands as described in U.S. Pat. NO. 5,360,712 which is incorporated herein by reference.

Preferred examples of the dopant include:

| | |
|---|---|
| TMC-1 | $[Ru(CN)_6]^{-4}$ |
| TMC-2 | $[Os(CN)_6]^{-4}$ |
| TMC-3 | $[Fe(CN)_6]^{-4}$ |
| TMC-4 | $[RuF(CN)_5]^{-4}$ |
| TMC-5 | $[OsF(CN)_5]^{-4}$ |
| TMC-6 | $[FeF(CN)_5]^{-4}$ |
| TMC-7 | $[RuCl(CN)_5]^{-4}$ |
| TMC-8 | $[OsCl(CN)_5]^{-4}$ |
| TMC-9 | $[FeCl(CN)_5]^{-4}$ |
| TMC-10 | $[RuBr(CN)_5]^{-4}$ |
| TMC-11 | $[OsBr(CN)_5]^{-4}$ |
| TMC-12 | $[FeBr(CN)_5]^{-4}$ |
| TMC-13 | $[RuI(CN)_5]^{-4}$ |
| TMC-14 | $[OsI(CN)_5]^{-4}$ |
| TMC-15 | $[FeI(CN)_5]^{-4}$ |
| TMC-16 | $[RuF_2(CN)_4]^{-4}$ |
| TMC-17 | $[OsF_2(CN)_4]^{-4}$ |
| TMC-18 | $[FeF_2(CN)_4]^{-4}$ |
| TMC-19 | $[RuCl_2(CN)_4]^{-4}$ |
| TMC-20 | $[OsCl_2(CN)_4]^{-4}$ |
| TMC-21 | $[FeCl_2(CN)_4]^{-4}$ |
| TMC-22 | $[RuBr_2(CN)_4]^{-4}$ |
| TMC-23 | $[OsBr_2(CN)_4]^{-4}$ |
| TMC-24 | $[FeBr_2(CN)_4]^{-4}$ |
| TMC-25 | $[RuI_2(CN)_4]^{-4}$ |
| TMC-26 | $[(OsI_2(CN)_4]^{-4}$ |
| TMC-27 | $[FeI_2(CN)_4]^{-4}$ |
| TMC-28 | $[Ru(CN)_5(OCN)]^{-4}$ |
| TMC-29 | $[Os(CN)_5(OCN)]^{-4}$ |
| TMC-30 | $[Fe(CN)_5(OCN)]^{-4}$ |
| TMC-31 | $[Ru(CN)_5(SCN)]^{-4}$ |
| TMC-32 | $[Os(CN)_5(SCN)]^{-4}$ |
| TMC-33 | $[Fe(CN)_5(SCN)]^{-4}$ |
| TMC-34 | $[Ru(CN)_5(N_3)]^{-4}$ |
| TMC-35 | $[OS(CN)_5(N_3)]^{-4}$ |
| TMC-36 | $[Fe(CN)_5(N_3)]^{-4}$ |
| TMC-37 | $[Ru(CN)_5(H_2O)]^{-3}$ |
| TMC-38 | $[Os(CN)_5(H_2O)]^{-3}$ |
| TMC-39 | $[Fe(CN)_5(H_2O)]^{-3}$ |
| TMC-40 | $[Ru(SCN)_6]^{-4}$ |
| TMC-41 | $[Os(SCN)_6]^{-4}$ |
| TMC-42 | $[Fe(SCN)_6]^{-4}$ |

-continued

| | |
|---|---|
| TMC-43 | $[Ru(OCN)_6]^{-4}$ |
| TMC-44 | $[Os(OCN)_6]^{-4}$ |
| TMC-45 | $[Fe(OCN)_6]^{-4}$ |
| TMC-46 | $[Pt(CN)_4]^{-2}$ |
| TMC-47 | $[Pt(CN)_4Cl_2)^{-2}$ |
| TMC-48 | $[Pt(CN)_4Br_2]^{-2}$ |
| TMC-49 | $[Pt(CN)_4I_2]^{-2}$ |

The grain surface modifier of the present invention preferably has the structure $$[TE_4(NZ)E']^r$$

where

T is a transition metal selected from Groups 5 to 10, inclusive, of the periodic table, and is preferably one selected from Group 8 of the periodic table;

Z is oxygen or sulfur, and together with nitrogen forms the nitrosyl or thionitrosyl ligand;

E and E' represent ligands additional to the nitrosyl or thionitrosyl ligand; and r is 0, −1, −2, or −3.

The additional ligand defined above by E include aquo ligands, halide ligands, cyanide ligands, cyanate ligands, thiocyanate ligands, selenocyanate ligands, tellurocyanate ligands, azide ligands and organic ligands. The ligand defined above by E' represents either E, nitrosyl or thionitrosyl.

Preferred grain surface modifiers include

| | |
|---|---|
| TMC-50 | $[Ru(NO)Cl_5]^{-2}$ |
| TMC-51 | $[Ru(NO)Br_5]^{-2}$ |
| TMC-52 | $[Ru(NO)I_5]^{-2}$ |
| TMC-53 | $[Ru(NO)F_5]^{-2}$ |
| TMC-54 | $[Ru(NO)Cl_3(H_2O)_2]^0$ |
| TMC-55 | $[Ru(NO)Cl_3(H_2O)]^{-1}$ |
| TMC-56 | $[Ru(NO)Cl_4(OCN)]^{-2}$ |
| TMC-57 | $[Ru(NO)Cl_4(CN)]^{-2}$ |
| TMC-58 | $[Ru(NO)I_4(TeCN)]^{-2}$ |
| TMC-59 | $[Ru(NO)Cl_4(SCN)]^{-2}$ |
| TMC-60 | $[Ru(NO)Br_4(SeCN)]^{-2}$ |
| TMC-61 | $[Ru(NO)I_4(SeCN)]^{-2}$ |
| TMC-62 | $[Ru(NO)Cl_3(CN)_2]^{-2}$ |
| TMC-63 | $[Ru(NO)Br_2(CN)_3]^{-2}$ |
| TMC-64 | $[Ru(NO)I_2(CN)_2]^{-2}$ |
| TMC-65 | $[Ru(NO)Cl_4(N)_3]^{-2}$ |
| TMC-66 | $[Ru(NO)Cl(CN)_4]^{-2}$ |
| TMC-67 | $[Ru(NO)Br(SCN)_4]^{-2}$ |
| TMC-68 | $[Ru(NO)I(SCN)_4]^{-2}$ |
| TMC-69 | $[Ru(NO)I(CN)_5]^{-2}$ |
| TMC-70 | $[Os(NO)Cl_5]^{-2}$ |
| TMC-71 | $[Os(NO)Br_5]^{-2}$ |
| TMC-72 | $[Os(NO)I_5]^{-2}$ |
| TMC-73 | $[Os(NO)F_5]^{-2}$ |
| TMC-74 | $[Os(NO)Cl_4(TeCN)]^{-2}$ |
| TMC-75 | $[Os(NO)Br_4(OCN)]^{-2}$ |
| TMC-76 | $[Os(NO)I_4(TeCN)]^{-2}$ |
| TMC-77 | $[Os(NO)Cl_4(SeCN)]^{-2}$ |
| TMC-78 | $[Os(NO)Br_4(SeCN)]^{-2}$ |
| TMC-79 | $[Os(NO)I_4(SeCN)]^{-2}$ |
| TMC-80 | $[Os(NO)Cl_3(CN)_2]^{-2}$ |
| TMC-81 | $[Os(NO)Br_2(CN)_3]^{-2}$ |
| TMC-82 | $[OS(NO)I_2(SCN)_3]^{-2}$ |
| TMC-83 | $[Os(NO)Cl_2(SCN)_3]^{-2}$ |
| TMC-84 | $[Os(NO)Cl(CN)_4]^{-2}$ |
| TMC-85 | $[Os(NO)Br(CN)_4]^{-2}$ |
| TMC-86 | $[Os(NO)I(SCN)_4]^{-2}$ |
| TMC-87 | $[Os(NO)(CN)_5]^{-2}$ |
| TMC-88 | $[Ru(NS)Cl_5]^{-2}$ |
| TMC-89 | $[Os(NS)Br_5]^{-2}$ |
| TMC-90 | $[Ru(NS)I_5]^{-2}$ |

-continued

| | |
|---|---|
| TMC-91 | $[OS(NS)Cl_4(N_3)]^{-2}$ |
| TMC-92 | $[Ru(NS)Br_4(N_3)]^{-2}$ |
| TMC-93 | $[OS(NS)I_4(N_3)]^{-2}$ |
| TMC-94 | $[Ru(NS)Cl_4(CN)]^{-2}$ |
| TMC-95 | $[Os(NS)Br_4(CN)]^{-2}$ |
| TMC-96 | $[Ru(NS)I_4(CN)]^{-2}$ |
| TMC-97 | $[Os(NS)Cl_4(SCN)]^{-2}$ |
| TMC-98 | $[Ru(NS)Br_4(SCN)]^{-2}$ |
| TMC-99 | $[Os(NS)I_4(SCN)]^{-2}$ |
| TMC-100 | $[Ru(NS)Cl_4(SeCN)]^{-2}$ |
| TMC-101 | $[Os(NS)Br_4(SeCN)]^{-2}$ |
| TMC-102 | $[Ru(NS)I_4(SeCN)]^{-2}$ |
| TMC-103 | $[OS(NS)Cl_3(N_3)_2]^{-2}$ |
| TMC-104 | $[Ru(NS)Br_3(CN)_2]^{-2}$ |
| TMC-105 | $[OS(NS)Cl_3(SCN)_2]^{-2}$ |
| TMC-106 | $[Ru(NS)Cl_3(SeCN)_2]^{-2}$ |
| TMC-107 | $[Ru(NS)Cl_2(N_3)_3]^{-2}$ |
| TMC-108 | $[OS(NS)I_2(CN)_3]^{-2}$ |
| TMC-109 | $[Os(NS)Br_2(SCN)_3]^{-2}$ |
| TMC-110 | $[Ru(NS)Cl_2(SeCN)_3]^{-2}$ |
| TMC-111 | $[Ru(NS)Cl_2(N_3)_3]^{-2}$ |
| TMC-112 | $[OS(NS)I_2(CN)_3]^{-2}$ |
| TMC-113 | $[Ru(NS)Br_2(SCN)_3]^{-2}$ |
| TMC-114 | $[Os(NS)Cl_2(SeCN)_3]^{-2}$ |
| TMC-115 | $[OS(NS)Cl(N_3)_4]^{-2}$ |
| TMC-116 | $[Ru(NS)I(CN)_4]^{-2}$ |
| TMC-117 | $[Ru(NS)Cl(SCN)_4]^{-2}$ |
| TMC-118 | $[Os(NS)Cl(SeCN)_4]^{-2}$ |
| TMC-119 | $[Ru(NS)(CN)_5]^{-2}$ |
| TMC-120 | $[Ru(NS)(SCN)_5]^{-2}$ |
| TMC-121 | $[Os(NS)(SeCN)_5]^{-2}$ |
| TMC-122 | $[Ru(NS)(N_3)_5]^{-2}$ |
| TMC-123 | $[Fe(NO)(CN)_5]^{-2}$ |

The grain surface modifier of the present invention is preferably applied to the emulsion during finishing. Finishing relates to any procedure performed subsequent to silver halide precipitation whereby substances are added to the emulsion in order to modify the surfaces of the silver halide grains. It therefore includes such procedures as chemical and spectral sensitization.

Finishing may also include a procedure wherein the grain surface modifier is deposited at intervals along the surface of the silver halide grains in a silver halide carrier. The silver halide carrier, in such instances, accounts for less than about two, and preferably less than about one, mole percent of the crystals' total halide content.

Finishing in this manner is preferably performed by means of Lippmann halide carriers—e.g., Lippmann bromide, chloride, bromochloride, chlorobromide, or iodochlorobromide or iodobromochloride wherein iodide content is less than about 10 mole percent. Specifically, a Lippmann halide emulsion (which is a very fine grain silver halide emulsion having average grain sizes around 0.05 microns) will have incorporated in its grains certain levels of the grain surface modifier. These emulsions are digested in the presence of the much larger silver halide grains of the present invention. They are then allowed to recrystalize on the surface of the larger grains, thus delivering the grain surface modifier.

Because the Lippmann halide carriers account for less than about two, and preferably less than about one, mole percent of the total halide in the silver halide grains, they do not form a shell around the larger grains. Rather, they form deposits at intervals along the surface of the grains. Generally, these deposits will form at the corners of the silver halide grains.

It is also possible to form the emulsions of the present invention by adding, post-precipitation, the grain surface modifier alone to a doped emulsion. However, it is preferred to apply the grain surface modifier by means of Lippmann halide carriers which will bind to the surface of the much larger silver halide grains. If Lippmann halide carriers are not used, and the silver halide grains are predominantly silver chloride, it is preferred to apply the grain surface modifier along with a solution of potassium halide (typically bromide or chloride). As small amounts of the halide displace halide molecules on the surface of the silver halide grain, the grain surface modifier will tend to be adsorbed into the grain surfaces.

The hexacoordination complex comprising iridium preferably has the structure:

$$R_qIrX_6$$

wherein

R represents a hydrogen atom, an alkali metal atom, or an ammonium radical;

q is 2, 3 or 4; and

X represents a ligand, preferably a halogen ligand (e.g., a chlorine or bromine atom) or other anionic ligand, or an organic ligand as described in U.S. Pat. No. 5,360,712

Exemplary ligands include aquo ligands, halide ligands, cyanide ligands, cyanate ligands, thiocyanate ligands, selenocyanate ligands, tellurocyanate ligands, azide ligands, and organic ligands. Combinations of the above ligands are also contemplated. It is preferred that the ligands be other than nitrosyl or thionitrosyl ligands.

The hexacoordination complex comprising iridium is water soluble. When dissolved in water, $R_q$ dissociates as cations while the iridium atom and the ligands disperse as a hexacoordination anionic complex.

The hexacoordination complex exhibits a spatial configuration that is compatible with the face centered cubic crystal lattice prevalent in photographically useful silver halides. The six ligands are spatially comparable to the six halide ions that are adjacent to a silver ion in the crystal structure. Thus, they may in fact be halide ions. They may also be any ligand, single or multielemental, that is capable of being spatially and electrically accommodated into the silver halide crystal lattice. A comprehensive discussion of hexacoordination complexes can be found in McDugle et al. U.S. Pat. No. 4,933,272, which is incorporated herein by reference.

Like the dopant, the hexacoordination complex comprising iridium can be incorporated anywhere in the silver halide grains. It can be incorporated through at least 50 percent, at least 75 percent, or at least 90 percent of the volume of the silver halide grains. It is preferable, however, that incorporation of the hexacoordination complex be towards the outer regions of the silver halide grains. In this regard, it is preferred that the hexacoordination complex be incorporated throughout the outer 80–98 percent region of the grains, the region being defined with respect to total volume of the grains. It is more preferred that the hexacoordination complex be banded in the region comprising the outer 85 to 95 percent, and optimally the outer 90 to 95 percent, of the volume of the grains.

It is also specifically contemplated that the hexacoordination complex comprising iridium be incorporated on the surface of the silver halide grains as a grain surface modifier. In this regard, application of such a complex can be as described above with respect to the other grain surface modifier. It is preferred that when the hexacoordination complex is applied to the grains in a Lippmann halide carrier, the carrier accounts for no more than about two, and preferably no more than about one, mole percent of the of the total halide in the silver halide grains.

Specific examples of the hexacoordination complex comprising iridium include $K_2IrCl_6$, $K_3IrCl_6$, $K_2IrBr_6$, $K_3IrBr_6$, $K_2IrCl_5(H_2O)$, $K_2IrCl_5$(thiazole) $K_2IrCl_5$(pyrazine), $K_3Ir(CN)_6$, $K_3Ir(CN)_5Cl$, $K_3Ir(CN)_4I_2$ and $K_4Ir(CN)_6$.

The grain surface modifier, dopant, and hexacoordination complex comprising iridium that are used in the present invention are preferably applied to a silver chloride emulsion which has been ripened in the presence of a ripening agent. Also, it is preferred that the dopant be applied to the emulsion in an amount between about $1.0\times10^{-6}$ and about $5.0\times^{10-4}$ moles per mole of silver chloride; that the grain surface modifier be applied in an amount between about $7.5\times10^{-10}$ and about $3.0\times10^{-8}$ moles per mole of silver chloride; and that the hexacoordination complex comprising iridium be applied in an amount between $1.0\times10^{-9}$ and about $1.0\times10^{-4}$ moles per mole of silver chloride, regardless of whether it is applied as a dopant or grain surface modifier.

Preferably, the dopant is applied in an amount between about $1.0\times10^{-6}$ and about $4.0\times10^{-5}$ moles per mole of silver chloride. Optimally, it is in an amount between about $3.9\times10^{-6}$ and about $3.2–10^{-5}$ moles per mole of silver chloride.

The grain surface modifier in such instances is preferably in an amount between about $1.0\times10^{-9}$ and about $2.0\times10^{-8}$ moles per mole of silver chloride. Optimally, it is fin an amount between about $3.0\times10^{-9}$ and about $1.8\times10^{-8}$ moles per mole of silver chloride.

When the amounts of dopant and grain surface modifier are as described above, the hexacoordination complex is preferably utilized in an amount between about $2.0\times10^{-9}$ and about $1.0\times10^{-5}$ moles per mole of silver chloride. More preferably it is used in an amount between about $5.0\times10^{-9}$ and about $5.0\times10^{-6}$ moles per mole of silver chloride.

The silver halide grains capable of being used in the present invention are of any known type. They can be formed of bromide ions as the sole halide, chloride ions as the sole halide, or any mixture of the two. They may also have incorporated within, minor amounts of iodide ions. Generally, though, iodide concentrations in silver halide grains seldom exceed 20 mole percent and are typically less than 10 mole percent, based on silver. However, specific applications differ widely in their use of iodide. In high speed (ASA 100 or greater) camera films, silver bromoiodide emulsions are employed since the presence of iodide allows higher speeds to be realized at any given level of granularity. In radiography, silver bromide emulsions or silver bromoiodide emulsions containing less than 5 mole percent iodide are customarily employed. Emulsions employed for the graphic arts and color paper, by contrast, typically contain greater than 50 mole percent chloride. Preferably they contain greater than 70 mole percent, and optimally greater than 85 mole percent, chloride. The remaining halide in such emulsions is preferably less than 5 mole percent, and optimally less than 2 mole percent, iodide, with any balance of halide not accounted for by chloride or iodide being bromide.

The advantages of the invention would be present in any of the above-mentioned types of emulsions, although it is preferred that the emulsions comprise silver chloride grains which are substantially free of silver bromide or silver iodide. By substantially free, it is meant that such grains are greater than about 90 mole percent silver chloride. Preferably, silver chloride accounts for greater than about 95 mole percent of the silver halide in the emulsion. Optimally, it accounts for about 97–99 mole percent.

The invention may be practiced with any of the known techniques for emulsion preparation. Such techniques include those which are normally utilized, for instance single jet or double jet precipitation; or they may include forming a silver halide emulsion by the nucleation of silver halide grains in a separate mixer or first container with later growth in a second container. All of these techniques are referenced in the patents discussed in *Research Disclosure, Dec.* 1989, Item 308119, Sections I–IV at pages 993–1000.

After precipitation of the silver halide grains in the presence of the dopant, the doped emulsions are washed to remove excess salt. At this time the grain surface modifier of the present invention may be added, or it may be added at a later time such as during chemical or spectrally sensitization. Both chemical and spectral sensitization may be performed in any conventional manner as disclosed in the above-referenced Research Disclosure, Item 308119. The hexacoordination complex comprising iridium can be added when the dopant is added, when the grain surface modifier is added, or at any other suitable time during the preparation of the emulsion. Incorporated herein by reference are U.S. Pat. No. 5,256,530 and 5,252,451 which disclose suitable methods for applying dopants and grain surface modifiers to the emulsions of the present invention.

As noted, the present invention may be practiced with silver halide grains having any halide composition. The invention may also be practiced with silver halide grains having any form (i.e. cubic, octahedral, dodecahedral, spherical or tabular). It is preferred, however, that the present invention be practiced with tabular grains having an aspect ratio greater than 2:1, preferably at least 5:1, and optimally at least 7:1. Aspect ratio as used herein is understood to mean the ratio of the equivalent circular diameter of a grain to its thickness. The equivalent circular diameter of a grain is the diameter of a circle having an area equal to the projected area of the grain.

The photographic emulsions of the present invention may be incorporated into photographic elements as are known in the art. These may include simple single layer elements or multilayer, multicolor elements. Multicolor elements contain dye imageforming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta imageforming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as in U.S. Pat. 4,279,945 and 4,302,523. Typically, the element will have a total thickness (excluding the support) of from about 5 to about 30 microns.

In the following discussion of suitable materials for use with or in the emulsions of this invention, reference will be made to *Research Disclosure*, Dec. 1978, Item 17643, and *Research Disclosure*, Dec. 1989, Item 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures*.

As noted above, the silver halide emulsions employed in this invention can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. 4,434,226, Daubendiek et al. U.S. Pat. 4,414,310, Wey U.S. Pat. 4,399,215, Solberg et al. U.S. Pat. 4,433,048, Mignot U.S. Pat. 4,386,156, Evans et al. U.S. Pat. 4,504,570, Maskasky U.S. Pat. 4,400,463, Wey et al. U.S. Pat. 4,414,306, Maskasky U.S. Pat. 4,435,501 and 4,643,966 and Daubendiek et al. U.S. Pat. 4,672,027 and 4,693,964, all of which are incorporated herein by reference. Also specifically contemplated are those silver iodobromide grains with a higher mole proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all of which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Other dopants may be added to the emulsions. Examples of dopants include compounds of copper, thallium, lead, bismuth, cadmium and Group VIII noble metals. The dopants can include transition metal complexes as described in U.S. Pat. No. 4,981,781, 4,937,180, and 4,933,272.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent.

The silver halide emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure*, Item 308119, cited above, Section IV.

Suitable vehicles for the emulsion layer and other layers of the photographic elements are described in *Research Disclosure*, Item 308119, Section IX and the publications cited therein.

The elements can include couplers as described in *Research Disclosure*, Section VII, paragraphs D, E, F, and G and the publications cited therein. The couplers can be incorporated as described in *Research Disclosure*, Section VII, paragraph C, and the publications cited therein. Also contemplated are elements which further include image modifying couplers as described in *Research Disclosure*, Item 308119, Section VII, paragraph F.

The photographic elements can contain brighteners (*Research Disclosure*, Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl1,3,3a,7-tetraazaindene), and those described in *Research Disclosure*, Section VI, antistain agents and image dye stabilizers (*Research Disclosure*, Section VII, paragraphs I and J), light absorbing and scattering materials (*Research Disclosure*, Section VIII), hardeners (*Research Disclosure*, Section X), polyalkyleneoxide and other surfactants as described in U.S. Pat. No. 5,236,817, coating aids (*Research Disclosure*, Section XI), plasticizers and lubricants (*Research Disclosure*, Section XII), antistatic agents (*Research Disclosure*, Section XIII), matting agents (*Research Disclosure*, Section XII and XVI) and development modifiers (*Research Disclosure*, Section XXI.

The photographic elements can be coated on a variety of supports as described in *Research Disclosure*, Section XVII and the references described therein.

The photographic elements can be exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(b-methanesulfonamidoethyl)-aniline sulfate hydrate, 4-amino-3-methyl-N-ethyl-N-(b-hydroxyethyl)-aniline sulfate, 4-amino-3-(b-methanesulfonamidoethyl)-N,N-diethylaniline hydrochloride, and 4-amino-N-ethyl-N-(b-methoxyethyl)-m-toluidine di-p-toluenesulfonic acid.

With negative-working silver halide emulsions, the processing step described above provides a negative image. The described elements can be processed in the known C-41 or RA-4 color processes. To provide a positive (or reversal) image, the color development step can be preceded by development with a non-chromogenic developing agent to develop exposed silver halide, but not form dye, and then uniformly fogging the element to render unexposed silver halide developable. Reversal processing of the element is preferably done in accordance with the known E6 process as described and referenced in *Research Disclosure* paragraph XIX. Alternatively, a direct positive emulsion can be employed to obtain a positive image.

Development is followed by the conventional steps of bleaching, fixing, or bleach-fixing, to remove silver or silver halide, washing, and drying.

The invention can be better appreciated by reference to the following specific examples. They are intended to be illustrative and not exhaustive of the grains of the present invention and their methods of formation.

EXAMPLES

Examples 1–8 were prepared in such a manner that the dopant was incorporated throughout an inner 50 or outer 49 percent core region (by volume) of the silver halide grains, and the grain surface modifier was applied using a Lippmann bromide carrier that accounted for less than about 1 percent of the total silver halide of the grains.

In Examples 1 to 4, the hexacoordination complex comprising iridium was incorporated into the silver halide grains as a dopant. Specifically, it was banded in the outer 93 to 95 percent region (by volume) of each grain.

In Examples 5 to 8, the hexacoordination complex comprising iridium was incorporated onto the surfaces of each grain as a grain surface modifier utilizing a Lippmann bromide carrier emulsion.

The emulsions for examples 1-8 were prepared by conventional precipitation methods employing thioether silver halide ripening agents of the type disclosed in McBride U.S. Pat. No. 3,271,157.

The emulsions were coated on paper support using sizing methods disclosed in U.S. Pat. No. 4,994,147. Specifically, they were coated at 0.28 grams/$m^2$ silver with 0.002 grams/$m^2$ of 2,4-dihydroxy-4- methyl-1-piperidinocyclopenten-3-one, 0.02 grams/$m^2$ of KCl, 0.78 mg/$m^2$ of potassium tolylthiosulfonate, 7.8 mg/$m^2$ of sodium tolylsulfinate, and with 1.08 grams/$m^2$ of the yellow dye forming coupler N-(5-((4-(2,4 bis(1,1-dimethylpropyl)phenoxy)-1-oxobutyl)amino)-2- chlorophenyl)-4,4-dimethyl-3-oxo-2-(4-((4-(phenylmethoxy)phenyl)sulfony)phenoxy)-pentanamide and 0.166 grams/$m^2$ gelatin. A 1.1 grams/$m^2$ gelatin protective overcoat layer was applied along with a vinylsulfone gelatin hardener.

The coatings were exposed through a step tablet to a 3000° K. light source for 0.1 second and processed as recommended in "Using KODAK EKTACOLOR RA Chemicals", Publication No. Z-130, published by Eastman Kodak. Co., 1990. After processing, the Status A reflection densities of each coating were measured.

A series of Lippmann bromide carrier emulsions was prepared for the addition of $Os(NO)Cl_5$ and $K_2IrCl_6$ as grain surface modifiers. The Lippmann bromide carriers were prepared as follows:

Emulsion L-1:

A rotation vessel containing 4.0 liters of a 5.6 percent by weight gelatin aqueous solution was adjusted to a temperature of 40° C., a pH of 5.8, and a pAg of 8.86 by addition of AgBr solution. A 2.5 molar solution containing 1698.7 grams of $AgNO_3$ in water and a 2.5 molar solution containing 1028.9 grams of NaBr in water were simultaneously run into the reaction vessel with rapid stirring. The double jet precipitation continued for 3 minutes at a controlled pAg of 8.86, after which the double jet precipitation was continued for 17 minutes. The pAg during this period was decreased linearly from 8.86 to 8.06. A total of 10 moles of silver bromide (Lippmann bromide) was precipitated, the silver bromide having an average grain size of 0.05 microns.

Emulsion L-2:

Emulsion L-2 was prepared exactly as Emulsion L-1 except 0.011 grams of $Cs_2Os(NO)Cl_5$ were added to the 2.5 molar NaBr solution. This double jet precipitation produced 10 moles of a 0.05 micron particle diameter emulsion containing $1.66\times10^{-6}$ moles $Os(NO)Cl_5$ per mole silver bromide.

Emulsion L-3:

Emulsion L-3 was prepared exactly as Emulsion L-1 except 0.075 grams of $K_2IrCl_6$ were added to the 2.5 molar NaBr solution which was added during 75–80 percent of the double jet precipitation. This double jet precipitation produced 10 moles of a 0.05 micron particle diameter emulsion containing $1.5\times10^{-5}$ moles $K_2IrCl_6$ per mole silver bromide.

EXAMPLE 1

Emulsion 1 was prepared in a reaction vessel wherein 8.5 liters of a 2.8 percent by weight gelatin aqueous solution and 1.8 grams of 1,8-dihydroxy-3,6dithiaoctane were adjusted to a temperature of 68.3° C., pH of 5.8, and a pAg of 7.35 by addition of NaCl solution. A 3.75 molar solution containing 1658.0 grams of $AgNO_3$ in water and a 3.75 molar solution containing 570.4 grams of NaCl in water were simultaneously run into the reaction vessel with rapid stirring. The double jet precipitation was controlled at a pAg of 7.35. A total of 9.76 moles of silver chloride was precipitated, the grains having cubic morphology of 0.60 micron average edge length.

Emulsion 1 was spectrally and chemically sensitized by heating a 50 millimole (mmole) sample of emulsion to 40° C., adding 280 milligrams of yellow spectral sensitizing dye anhydro 3,3'-di-3-sulfopropyl-5'-chloro-naphtho[ 1,2-d] thiazolothlacyanine hydroxide, tetrabutylammonium salt, and then adding 0.3 mmoles of Emulsion L-1. The temperature was raised to 60° C. to accelerate application of the Lippmann bromide to the grain surfaces. Addition of sodium thiosulfate and 4-hydroxy-6-methyl 1,3,3a,7-tetraazaindene followed and the emulsion was maintained at 60° C. Addition of 1-(3-acetamidophenyl)-5-mercaptotetrazole followed to complete the spectral and chemical sensitization.

Emulsion 2 was prepared and sensitized exactly as Emulsion 1 except that 0.06 mmoles of Emulsion L-2 and 0.24 mmoles of Emulsion L-1 were added during the sensitization process instead of 0.3 mmoles of Emulsion L-1. Thus, $3.0\times10^{-9}$ moles of $Os(NO)Cl_5$ per mole of silver chloride were added to Emulsion 2 as a grain surface modifier.

Emulsion 3 was prepared exactly as Emulsion 1 except 0,103 grams of $K_4Fe(CN)_{6.3}(H_2O)$ were added to the 3.75 NaCL solution during the initial 50 percent of the double jet precipitation (0–50%). A total of 9.76 moles of silver chloride containing $25.0\times10^{-6}$ moles $Fe(CN)_6$ per mole silver chloride was precipitated. The morphology was cubic with average cubic edge length of 0.60 microns.

Emulsion 4 was prepared exactly as Emulsion 1 except 0,145 milligrams of K3IrC16 were added to the 3.75 NaCl solution during 93-95 percent of the double jet precipitation. A total of 9.76 moles of silver chloride containing $28.5\times10^{-9}$ moles $K_3IrCl_6$ per mole silver chloride was precipitated. The morphology was cubic with an average cubic edge length of 0.60 microns.

Emulsion 5 was prepared exactly as Emulsion 1 except 2.0 micrograms of $K_4Fe(CN)_6.3(H_2O)$ were added to the 3.75 NaCl solution during the initial 50 percent of the double jet precipitation; and 0.145 milligrams of $K_3IrCl_6$ were added during 93-95 percent. A total of 9.76 moles of silver chloride containing $25.0\times10^{-6}$ moles $Fe(CN)_6$ per mole silver chloride and $28.5\times10^{-9}$ moles K3IrC16 per mole silver chloride were precipitated. The morphology was cubic with average cubic edge length of 0.60 microns.

Emulsion 6 was prepared exactly as Emulsion 2 except that Emulsion 4 was used instead of Emulsion 1. Thus, $3.0\times10^{-9}$ moles of $Os(NO)Cl_5$ per mole silver chloride were added to Emulsion 6 as a grain surface modifier, while $28.5\times10^{-9}$ moles of $K3IrCl_6$ per mole silver chloride were added as a dopant.

Emulsion 7 was prepared and sensitized exactly as Emulsion 2 except that Emulsion 3 was used instead of Emulsion 1. Thus, $3.0\times10^{-9}$ moles of $Os(NO)Cl_5$ per mole silver chloride were added to Emulsion 7 as a grain surface modifier, while $25.0\times10^{-6}$ moles of $Fe(CN)_6$ per mole silver chloride were added as a dopant.

Emulsion 8 was prepared and sensitized exactly as Emulsion 2 except that Emulsion 5 was used instead of Emulsion 1. Thus, $3.0\times10^{-9}$ moles of $Os(NO)Cl_5$ per mole silver chloride were added to Emulsion 8 as a grain surface modifier, while $25.0\times10^{-6}$ moles of $Fe(CN)_6$ per mole silver chloride and $28.5\times10^{-9}$ moles of $K_3IrCl_6$ per mole silver chloride were added as dopants.

EXAMPLE 1

| Emulsion | Grain Surface Modifer $Os(NO)Cl_5$[1] | Dopant $Fe(CN)_6$[2] | Ir[3] | Speed[4] | Gamma[5] | Percent Gamma Change |
|---|---|---|---|---|---|---|
| 1 | — | — | — | 137 | 2.33 | — |
| 2 | 3.0 | — | — | 130 | 2.77 | +19 |
| 3 | — | 25.0 | — | 148 | 2.30 | −1 |
| 4 | — | — | 28.5 | 173 | 2.51 | +8 |
| 5 | — | 25.0 | 28.5 | 174 | 2.69 | +15 |
| 6 | 3.0 | — | 28.5 | 146 | 3.50 | +50 |
| 7 | 3.0 | 25.0 | — | 137 | 3.09 | +33 |
| 8 | 3.0 | 25.0 | 28.5 | 146 | 3.83 | +64 |

[1]Mole parts per billion (TMC-70) $Os(NO)Cl_5$/mole AgCl.

[2]Mole parts per million (TMC-3) $Fe(CN)_6$/mole AgCl incorporated in a 0–50 percent core region.

[3]Mole parts per billion $K_3IrCl_6$/mole AgCl incorporated as a dopant in the 93–95 percent band.

[4]The reciprocal of the relative amount of light in LogE × 100 to produce 1.0 density.

[5]Slope of a line tangent to the sensitometric curve at the speed point.

Relative to Emulsion 1, inventive Emulsion 8 showed an increase in Gamma in excess of the sum of Emulsions 2–4, where each compound was used alone. The increase in Gamma for Emulsion 8 was also greater than the sum of Emulsions 2 and 5, Emulsions 3 and 6, or Emulsions 4 and 7, where specific combinations of compounds were utilized.

Example 1 demonstrates that an unexpected improvement in photographic contrast can be obtained when a combination of a dopant, grain surface modifier, and hexacoordination complex comprising iridium are incorporated into a photographic emulsion.

EXAMPLE 2

Emulsions 9, 10, 12, and 14 were prepared exactly as Emulsions 1, 2, 4, and 6, respectively. Emulsions 11, 13, 15, and 16 were prepared by the same procedures used in preparing Emulsions 3, 5, 7, and 8, respectively, except that the $Fe(CN)_6$ was added as a dopant during 50–99 percent of the precipitation instead of during 0–50 percent.

As with Example 1, Example 2 demonstrates that an unexpected improvement in photographic contrast can be obtained when the combination of a dopant, grain surface modifier, and hexacoordination complex comprising iridium are incorporated into a photographic emulsion.

Examples 3 and 4, shown below, demonstrate that the advantages of the invention are present when a ruthenium hexacyanide complex is utilized as the dopant. The examples also demonstrate that the present invention provides a means by which to advantageously control the Toe and Shoulder densities of a given photographic emulsion sensitometric curve. Thus, the present invention provides a means by which to control tone reproduction in photographic elements.

EXAMPLE 2

| Emulsion | Grain Surface Modifer $Os(NO)Cl_5$[1] | Dopant $Fe(CN)_6$[2] | Ir[3] | Speed[4] | Gamma[5] | Percent Gamma Change |
|---|---|---|---|---|---|---|
| 9 | — | — | — | 137 | 2.33 | — |
| 10 | 3.0 | — | — | 130 | 2.77 | +19 |
| 11 | — | 25.0 | — | 158 | 2.53 | +9 |
| 12 | — | — | 28.5 | 163 | 2.51 | +8 |
| 13 | — | 25.0 | 28.5 | 168 | 2.82 | +21 |
| 14 | 3.0 | — | 28.5 | 146 | 3.47 | +49 |
| 15 | 3.0 | 25.0 | — | 146 | 3.56 | +53 |
| 16 | 3.0 | 25.0 | 28.5 | 149 | 4.25 | +82 |

[1]Mole parts per billion (TMC-70) $Os(NO)Cl_5$/mole AgCl.
[2]Mole parts per million (TMC-3) $Fe(CN)_6$/mole AgCl incorporated in a 50–99 percent region.
[3]Mole parts per billion $K_3IrCl_6$/mole AgCl incorporated as a dopant in the 93–95 percent band.
[4]The reciprocal of the relative amount of light in LogE × 100 to produce 1.0 density.
[5]Slope of a line tangent to the sensitometric curve at the speed point.

Relative to Emulsion 9, inventive Emulsion 16 showed an increase in Gamma in excess of the sum of Emulsions 10–12, where each compound was used alone. The increase in Gamma for Emulsion 16 was also greater than the sum of Emulsions 10 and 13, Emulsions 11 and 14, or Emulsions 12 and 15, where specific combinations of the compounds were utilized.

EXAMPLE 3

Emulsions 17, 18, 20, and 22 were prepared exactly as Emulsions 1, 2, 4, and 6, respectively. Emulsions 19, 21, 23, and 24 were prepared by the same procedures used in preparing Emulsions 3, 5, 7, and 8, respectively, except that 0.101 grams of $K_4Ru(CN)_6$ were added during 0–50 percent of the precipitation instead of 0.103 grams of $K_4Fe(CN)_{6.3}(H_2O)$.

EXAMPLE 3

| Emulsion # | Grain Surface Modifier $Os(NO)Cl_5$[1] | Dopant $Ru(CN)_6$[2] | Ir[3] | Speed[4] | Gamma[5] | Percent Gamma Change | Toe Density[6] | Percent Toe Change |
|---|---|---|---|---|---|---|---|---|
| 17 | — | — | — | 132 | 2.15 | — | 0.500 | — |
| 18 | 3.0 | — | — | 122 | 2.76 | +28 | 0.377 | −25 |
| 19 | — | 25.0 | — | 140 | 2.13 | −1 | 0.481 | −4 |
| 20 | — | — | 28.5 | 155 | 1.68 | −22 | 0.453 | −9 |
| 21 | — | 25.0 | 28.5 | 159 | 2.44 | +13 | 0.368 | −26 |
| 22 | 3.0 | — | 28.5 | 134 | 2.74 | +27 | 0.273 | −45 |
| 23 | 3.0 | 25.0 | — | 132 | 2.86 | +33 | 0.347 | −31 |
| 24 | 3.0 | 25.0 | 28.5 | 140 | 3.43 | +60 | 0.240 | −52 |

[1]Mole parts per billion (TMC-70) $Os(NO)Cl_5$/mole AgCl.
[2]Mole parts per million (TMC-1) $Ru(CN)_6$/mole AgCl incorporated in a 0–50 percent region.
[3]Mole parts per billion $K_3IrCl_6$/mole AgCl incorporated as a dopant in the 93–95 percent band.
[4]The reciprocal of the relative amount of light in LogE × 100 to produce 1.0 density.
[5]Slope of a line tangent to the sensitometric curve at the speed point.
[6]The density value of the point 0.3 LogE fast of the speed point.

Relative to Emulsion 17, inventive Emulsion 24 showed an increase in Gamma and a decrease in Toe Density in excess of the sum of Emulsions 18–20, where each compound was used alone. Emulsion 24 also showed an increase in Gamma and a decrease in Toe Density in excess of the sum of emulsions where specific combinations of the compounds were utilized.

EXAMPLE 4

Emulsions 25, 26, 28, and 30 were prepared exactly as Emulsions 1, 2, 4, and 6, respectively. Emulsions 27, 29, 31, and 32, were prepared by the same procedures used in preparing Emulsions 3, 5, 7, and 8, respectively, except that 0.101 grams of $K_4Ru(CN)_6$ were added during 50–99 percent of the precipitation instead of 0.103 grams of $K_4Fe(CN)_6.3(H_2O)$.

EXAMPLE 4

| Emulsion # | Grain Surface Modifier $Os(NO)Cl_5$[1] | Dopant $Ru(CN)_6$[2] | Ir[3] | Speed[4] | Gamma[5] | Percent Gamma Change | Shoulder Density[6] | Percent Shoulder Change |
|---|---|---|---|---|---|---|---|---|
| 25 | — | — | — | 132 | 2.15 | — | 1.75 | — |
| 26 | 3.0 | — | — | 122 | 2.76 | +28 | 1.89 | +8 |
| 27 | — | 25.0 | — | 140 | 2.14 | — | 1.69 | −3 |
| 28 | — | — | 28.5 | 155 | 1.68 | −22 | 1.41 | −19 |
| 29 | — | 25.0 | 28.5 | 159 | 2.64 | +23 | 1.70 | −3 |
| 30 | 3.0 | — | 28.5 | 134 | 2.74 | +27 | 1.61 | −8 |
| 31 | 3.0 | 25.0 | — | 132 | 3.18 | +48 | 1.88 | +7 |
| 32 | 3.0 | 25.0 | 28.5 | 140 | 3.89 | +81 | 1.95 | +11 |

[1]Mole parts per billion (TMC-70) $Os(NO)Cl_5$/mole AgCl.
[2]Mole parts per million (TMC-1) $Ru(CN)_6$/mole AgCl incorporated in a 50–99 percent region.
[3]Mole parts per billion $K_3IrCl_6$/mole AgCl incorporated as a dopant in the 93–95 percent band.
[4]The reciprocal of the relative amount of light in LogE × 100 to produce 1.0 density.
[5]Slope of a line tangent to the sensitometric curve at the speed point.
[6]The density value of the point 0.3 LogE slow of the speed point.

Relative to Emulsion 25, inventive Emulsion 32 showed an increase in Gamma and Shoulder Density in excess of the sum of Emulsions 26–28, where each compound was used alone. Emulsion 32 also showed an increase in Gamma and Shoulder Density in excess of the sum of emulsions where specific combinations of the compounds were utilized.

Examples 5 through 8, shown below, demonstrate that the invention may also be practiced utilizing the hexacoordination complex comprising iridium as a grain surface modifer rather than as a dopant. Further, control over Gamma and Toe Density is also demonstrated.

EXAMPLE 5

Emulsions 33, 34, 35, and 39 were prepared exactly as Emulsions 1, 2, 3, and 7, respectively.

Emulsion 36 was prepared and sensitized exactly as Emulsion 1 except that 0.06 mmoles of Emulsion L-3 and 0.24 mmoles of Emulsion L-1 were added during the sensitization process instead of 0.3 mmoles of Emulsion L-1. Thus, $28.0\times10^{-9}$ moles of $K_2IrCl_6$ per mole silver chloride were added to Emulsion 36 as a grain surface modifier.

Emulsion 37 was prepared as Emulsion 3, and sensitized as Emulsion 36. Thus, $25.0\times10^{-6}$ moles of $Fe(CN)_6$ per mole silver chloride were added as a dopant and $28.0\times10^{9}$ moles of K2IrC16 per mole silver chloride were added to Emulsion 37 as a grain surface modifier.

Emulsion 38 was prepared and sensitized exactly as Emulsion 1 except that 0.06 mmoles of Emulsion L-2, 0.06 mmoles of Emulsion L-3 and 0.18 mmoles of Emulsion L-1 were added during the sensitization process instead of 0.3 mmoles of Emulsion L-1. Thus, 3.0×–9 moles of $Os(NO)Cl_5$ per silver and $28.0\times10^{-9}$ moles of $K_2IrCl6$ per mole silver chloride were each added to Emulsion 38 as a grain surface modifier.

Emulsion 40 was prepared as Emulsion 3, and sensitized as Emulsion 38. Thus, $25.0\times10^{-6}$ moles of $Fe(CN)_6$ per mole silver chloride were added as a dopant, and $3.0\times10^{-9}$ moles of $Os(NO)Cl_5$ and 28.0×10–9 moles of $K_2IrCl_6$ per mole silver chloride were each added as a grain surface modifier.

EXAMPLE 5

| Emulsion # | Grain Surface Modifer $Os(NO)Cl_5$[1] | Dopant $Fe(CN)_6$[2] | Ir[3] | Speed[4] | Gamma[5] | Percent Gamma Change |
|---|---|---|---|---|---|---|
| 33 | — | — | — | 137 | 2.33 | — |
| 34 | 3.0 | — | — | 125 | 2.88 | +24 |
| 35 | — | 25.0 | — | 144 | 2.36 | +1 |
| 36 | — | — | 28.0 | 164 | 3.07 | +32 |
| 37 | — | 25.0 | 28.0 | 167 | 3.24 | +39 |
| 38 | 3.0 | — | 28.0 | 147 | 3.87 | +66 |

-continued

EXAMPLE 5

| Emulsion # | Grain Surface Modifer $Os(NO)Cl_5$[1] | Dopant $Fe(CN)_6$[2] | Ir[3] | Speed[4] | Gamma[5] | Percent Gamma Change |
|---|---|---|---|---|---|---|
| 39 | 3.0 | 25.0 | — | 135 | 3.04 | +30 |
| 40 | 3.0 | 25.0 | 28.0 | 147 | 4.23 | +82 |

[1]Mole parts per billion (TMC-70) $Os(NO)Cl_5$/mole AgCl
[2]Mole parts per million (TMC-3) $Fe(CN)_6$/mole AgCl incorporated in a 0–50 percent region.
[3]Mole parts per billion $K_3IrCl_6$/mole AgCl incorporated as a grain surface modifier.
[4]The reciprocal of the relative amount of light in LogE × 100 to produce 1.0 density.
[5]Slope of a line tangent to the sensitometric curve at the speed point.

Relative to Emulsion 33, inventive Emulsion 40 showed an increase in Gamma in excess of the sum of Emulsions 34–36, where each compound was used alone. Emulsion 40 also showed an increase in Gamma in excess of the sum of emulsions where specific combinations of the compounds were utilized.

EXAMPLE 6

Emulsions 41, 42, 44, and 46 were prepared exactly as Emulsions 1, 2, 36, and 38, respectively. Emulsions 43, 45, 47, and 48 were prepared by the same procedures used in preparing Emulsions 35, 37, 39, and 40, respectively, except that the $Fe(CN)_6$ was added as a dopant during 50–99 percent of the precipitation instead of during 0–50 percent.

EXAMPLE 6

| Emulsion # | Grain Surface Modifer $Os(NO)Cl_5$[1] | Dopant $Fe(CN)_6$[2] | Ir[3] | Speed[4] | Gamma[5] | Percent Gamma Change |
|---|---|---|---|---|---|---|
| 41 | — | — | — | 137 | 2.33 | — |
| 42 | 3.0 | — | — | 127 | 2.85 | +22 |
| 43 | — | 25.0 | — | 155 | 2.33 | +0 |
| 44 | — | — | 28.0 | 163 | 3.02 | +30 |
| 45 | — | 25.0 | 28.0 | 170 | 3.10 | +33 |
| 46 | 3.0 | — | 28.0 | 146 | 4.36 | +87 |
| 47 | 3.0 | 25.0 | — | 146 | 3.55 | +52 |
| 48 | 3.0 | 25.0 | 28.0 | 148 | 4.59 | +97 |

[1]Mole parts per billion (TMC-70) $Os(NO)Cl_5$/mole AgCl
[2]Mole parts per million (TMC-3) $Fe(CN)_6$/mole AgCl incorporated in a 50–99 percent region.
[3]Mole parts per billion $K_2IrCl_6$/mole AgCl incorporated as a grain surface modifier.
[4]The reciprocal of the relative amount of light in LogE × 100 to produce 1.0 density.
[5]Slope of a line tangent to the sensitometric curve at the speed point.

Relative to Emulsion 41, inventive Emulsion 48 showed an increase in Gamma in excess of the sum of Emulsions 42-44, where each compound was used alone. Emulsion 48 also showed an increase in Gamma in excess of the sum of emulsions where specific combinations of the compounds were utilized.

EXAMPLE 7

Emulsions 49, 50, 52, and 54 were prepared exactly as Emulsions 1, 2, 36, and 38, respectively. Emulsions 51, 53, 55, and 56 were prepared by the same procedures used in preparing Emulsions 35, 37, 39, and 40, respectively, except that 0.101 grams of $K_4Ru(CN)_6$ were added during 0–50 percent of the precipitation instead of 0.103 grams of $K_4Fe(CN)_6.3(H_2O)$.

EXAMPLE 7

| Emulsion | Grain Surface Modifier $Os(NO)Cl_5$[1] | Dopant $Ru(CN)_6$[2] | Ir[3] | Speed[4] | Gamma[5] | Percent Gamma Change | ΔToe[6] Density | Percent ΔToe Change |
|---|---|---|---|---|---|---|---|---|
| 49 | — | — | — | 134 | 2.29 | — | 0.115 | — |
| 50 | 3.0 | — | — | 127 | 2.90 | +27 | 0.132 | +15 |
| 51 | — | 25.0 | — | 149 | 2.49 | +9 | 0.166 | +44 |
| 52 | — | — | 28.0 | 165 | 2.93 | +28 | 0.216 | +88 |
| 53 | — | 25.0 | 28.0 | 167 | 2.94 | +28 | 0.132 | +15 |

-continued

EXAMPLE 7

| Emulsion | Grain Surface Modifier $Os(NO)Cl_5$[1] | Dopant $Ru(CN)_6$[2] | Ir[3] | Speed[4] | Gamma[5] | Percent Gamma Change | ΔToe[6] Density | Percent ΔToe Change |
|---|---|---|---|---|---|---|---|---|
| 54 | 3.0 | — | 28.0 | 145 | 4.14 | +81 | 0.144 | +25 |
| 55 | 3.0 | 25.0 | — | 135 | 3.05 | +33 | 0.175 | +52 |
| 56 | 3.0 | 25.0 | 28.0 | 147 | 4.80 | +110 | 0.137 | +19 |

[1]Mole parts per billion (TMC-70) $Os(NO)Cl_5$/mole AgCl.
[2]Mole parts per million (TMC-1) $Ru(CN)_6$/mole AgCl incorporated in a 0–50 percent region.
[3]Mole parts per billion $K_2IrCl_6$/mole AgCl incorporated as a grain surface modifier.
[4]The reciprocal of the relative amount of light in LogE × 100 to produce 1.0 density.
[5]Slope of a line tangent to the sensitometric curve at the speed point.
[6]The change in the density value of the point 0.3 LogE fast of the speed point due to 3 week storage at 49° C. and 50% RH (relative humidity).

Relative to Emulsion 49, inventive Emulsion 56 showed an increase in Gamma in excess of the sum of Emulsions 50-52, where each compound was used alone. Emulsion 56 also showed an increase in Gamma in excess of the sum of emulsions where specific combinations of the compounds were utilized. Inventive Emulsion 56 also showed good storage stability as indicated by its low Percent ΔToe Density value.

EXAMPLE 8

Emulsions 57, 58, 60, and 62 were prepared exactly as Emulsions 1, 2, 36, and 38, respectively. Emulsions 59, 61, 63, and 64 were prepared by the same procedures used In preparing Emulsions 35, 37, 39, and 40, respectively, except that 0.101 grams of $K_4Ru(CN)_6$ were added during 50–99 percent of the precipitation instead of 0.103 grams of $K_4Fe(CN)_6.3(H20)$.

What is claimed is:

1. A photographic silver halide emulsion comprising silver halide grains having incorporated therein a dopant, and thereon a grain surface modifier, and further comprising a hexacoordination complex comprising iridium, wherein the grain surface modifier is a transition metal complex comprising a nitrosyl or thionitrosyl ligand with a transition metal selected from Group 8 of the periodic table, and the dopant is a transition metal complex comprising a transition metal, other than iridium, which is selected from Groups 7 to 10, inclusive, of the periodic table.

2. A photographic emulsion according to claim 1 wherein the dopant is a transition metal complex comprising a transition metal selected from Group 8 of the periodic table.

3. A photographic emulsion according to claim 2 wherein said silver halide grains contain silver chloride and are substantially free of silver bromide or silver iodide.

EXAMPLE 8

| Emulsion | Grain Surface Modifier $Os(NO)Cl_5$[1] | Dopant $Ru(CN)_6$[2] | Ir[3] | Speed[4] | Gamma[5] | Percent Gamma Change | ΔToe[6] Density | Percent ΔToe Change |
|---|---|---|---|---|---|---|---|---|
| 57 | — | — | — | 134 | 2.29 | — | 0.115 | — |
| 58 | 3.0 | — | — | 126 | 2.74 | +20 | 0.150 | +30 |
| 59 | — | 25.0 | — | 152 | 2.35 | +3 | 0.164 | +43 |
| 60 | — | — | 28.0 | 161 | 3.02 | +32 | 0.185 | +61 |
| 61 | — | 25.0 | 28.0 | 168 | 2.85 | +24 | 0.130 | +13 |
| 62 | 3.0 | — | 28.0 | 143 | 4.07 | +78 | 0.128 | +11 |
| 63 | 3.0 | 25.0 | — | 133 | 3.20 | +40 | 0.133 | −2 |
| 64 | 3.0 | 25.0 | 28.0 | 146 | 4.88 | +113 | 0.114 | −1 |

[1]Mole parts per billion (TMC-70) $Os(NO)Cl_5$/mole AgCl.
[2]Mole parts per million (TMC-1) $Ru(CN)_6$/mole AgCl incorporated in a 50–99 percent region.
[3]Mole parts per billion $K_2IrCl_6$/mole AgCl incorporated as a grain surface modifier.
[4]The reciprocal of the relative amount of light in LogE × 100 to produce 1.0 density.
[5]Slope of a line tangent to the sensitometric curve at the speed point.
[6]The change in the density value of the point 0.3 LogE fast of the speed point due to 3 week storage at 49° C. and 50% RH (relative humidity).

Relative to Emulsion 57, inventive Emulsion 64 showed improved Gamma and stability over comparative Examples 58–63 where specific compounds or combinations of the compounds were utilized.

The invention has been described in detail with particular reference to preferred embodiments thereof but it will be understood that variations and modifications can be effected within the spirit and scope of the invention.

4. A photographic emulsion according to claim 3 wherein the hexacoordination complex comprising iridium has the structure:

$$R_3IrX_6$$

wherein

R represents a hydrogen atom, an alkali metal atom, or an ammonium radical;

q is 2, 3, or 4; and

X represents a ligand.

5. A photographic emulsion according to claim 4 wherein X represents a halogen atom.

6. A photographic emulsion according to claim 2 wherein said grain surface modifier is positioned at intervals along the surface of said silver chloride grains in a silver halide carrier, said silver halide carrier accounting for less than about two mole percent of said silver halide grain.

7. A photographic emulsion according to claim 6 wherein said silver halide carrier accounts for less than about one mole percent of said silver halide grain.

8. A photographic emulsion according to claim 2 wherein said dopant comprises cyanide ligands.

9. A photographic emulsion according to claim 8 wherein said dopant has the structure:

$$[M(CN)_{6-y}L_y]^n$$

wherein

M is a Group 8 transition metal;

L is a ligand;

y is 0, 1, 2, or 3; and n is 0, −1, −2, −3, or −4.

10. A photographic emulsion according to claim 9 wherein said dopant is in the form of $Fe(CN)_6]^{-4}$.

11. A photographic emulsion according to claim 10 comprising $[Fe(CN)_6]^{-4}$ in an amount between about $1.0\times10^{-6}$ and about $5.0\times10^{-4}$ moles per mole of silver chloride.

12. A photographic emulsion according to claim 11 comprising $[Fe(CN)_6]^{-4}$ in an amount between about $1.0\times10^{-6}$ and about $4.0\times10^{-5}$ moles per mole of silver chloride.

13. A photographic emulsion according to claim 12 comprising $[Fe(CN)_6]^{-4}$ in an amount between about $3.9\times10^{-6}$ and about $3.2\times10^{-5}$ moles per mole of silver chloride.

14. A photographic emulsion according to claim 9 wherein said dopant is $[Ru(CN)_6]^{-4}$.

15. A photographic emulsion according to claim 14 comprising $[Ru(CN)_6]^{-4}$ in an amount between about $1.0\times10^{-6}$ and about $5.0\times10^{-4}$ moles per mole of silver chloride.

16. A photographic emulsion according to claim 15 comprising $[Ru(CN)_6]^{-4}$ in an amount between about $1.0\times10^{-6}$ and about $4.0\times10^{-5}$ moles per mole of silver chloride.

17. A photographic emulsion according to claim 16 comprising $[Ru(CN)_6]^{-4}$ in amounts between about $3.9\times10^{-6}$ and about $3.2\times10^{-5}$ moles per mole of silver chloride.

18. A photographic emulsion according to claim 1 wherein said grain surface modifier has the structure:

$$[TE_4(NZ)E']^r$$

where

T is a transition metal selected from the Group 8 of the periodic table;

Z is oxygen or sulfur, and together with nitrogen forms the nitrosyl or thionitrosyl ligand;

E and E' represent ligands; and r is 0, −1, −2, or −3.

19. A photographic emulsion according to claim 18 wherein said grain surface modifier is $[Os(NO)Cl_5]^{-2}$.

20. A photographic emulsion according to claim 19 wherein $[Os(NO)Cl_5]^{-2}$ is incorporated into said silver halide grain in an amount between about $7.5\times 10^{-10}$ and about $3.0\times10^{-8}$ moles per mole of silver chloride.

21. A photographic emulsion according to claim 20 wherein $[Os(NO)Cl_5]^{-2}$ is incorporated into said silver halide grains in an amount between about $1.0\times10^{-9}$ and about $2.0\times10^{-8}$ moles per mole of silver chloride.

22. A photographic emulsion according to claim 21 wherein $[Os(NO)Cl_5]^{-2}$ is incorporated into said silver halide grains in an amount between about $3.0\times10^{-9}$ and about $1.8\times10^{-8}$ moles per mole of silver chloride.

23. A photographic emulsion according to claim 1 wherein said dopant is incorporated throughout a care region that accounts for 90–95 percent of the volume of said silver halide grains.

24. A photographic silver halide emulsion comprising an iridium containing transition metal complex and silver halide grains that are formed in the presence of a dopant, the dopant being a transition metal complex and comprising a cyanide ligand and a transition metal selected from Group 8 of the periodic table; and that are modified subsequent to their formation by a grain surface modifier, the modifier being a transition metal complex comprising a transition metal selected from Group 8 of the periodic table with a nitrosyl or thionitrosyl ligand.

25. A photographic silver halide emulsion comprising silver halide grains having associated therewith, a grain surface modifier, a dopant, and a hexacoordination complex comprising iridium, wherein the grain surface modifier has the structure:

$$[TE_4(NZ)E']^r$$

where

T is a transition metal selected from the Group 8 of the periodic table;

Z is oxygen or sulfur, and together with nitrogen forms the nitrosyl or thionitrosyl ligand;

E and E' represent ligands; and r is zero, −1, −2, or −3;

the dopant has the structure:

$$[M(CN)_{6-y}L_y]^n$$

where

M is a Group 8 transition metal;

L is a ligand;

y is zero, 1, 2, or 3; and n is zero, −1, −2, −3, or −4; and the hexacoordination complex comprising iridium has the structure:

$$R_qIrX_6$$

where

R represents a hydrogen atom, an alkali metal atom, or an ammonium radical;

q is 2, 3 or 4; and

X represents a ligand.

* * * * *